US005131557A

United States Patent [19]

Stolzman

[11] Patent Number: 5,131,557

[45] Date of Patent: Jul. 21, 1992

[54] LOCKING COVER WITH FLANGED BELT

[76] Inventor: Michael D. Stolzman, 1188 Old Colony Rd., Lake Forest, Ill. 60045

[21] Appl. No.: 749,690

[22] Filed: Aug. 26, 1991

Related U.S. Application Data

[63] Continuation-in-part of Ser. No. 696,362, May 6, 1991.

[51] Int. Cl.[5] ..... B65D 45/34

[52] U.S. Cl. ..... 220/321; 220/306

[58] Field of Search ..... 220/306, 319, 320, 321

[56] References Cited

U.S. PATENT DOCUMENTS

| | | | |
|---|---|---|---|
| 3,642,166 | 2/1972 | Starr | 220/320 |
| 3,942,677 | 3/1976 | Hagen et al. | 220/304 |
| 4,805,798 | 2/1989 | Stolzman | 220/315 |

*Primary Examiner*—Stephen Marcus
*Assistant Examiner*—Nova Stucker
*Attorney, Agent, or Firm*—Wood, Phillips, VanSanten, Hoffman & Ertel

[57] ABSTRACT

A flanged belt is used with a closure and a container. The closure comprises a generally circular closure wall, a generally cylindrical sidewall having an upper edge connected to the closure wall and an annular lower edge that can have generally circumferentially spaced slits where the sidewall can be cut to allow for access to the container's internal storage space. The sidewall has a radially outwardly opening annular recess. The flanged belt comprises a long, thin, flexible strap having an outer side and an inner side. The flanges are circumferentially spaced and longitudinally extend along the inner side of the belt. Each flange defines a parallelepiped. The flanges are spaced apart at a distance slightly greater than the distance between reinforcement ribs contained in the sidewall annular recess. The flanges taken together have an inner diameter less than the closure sidewall outer diameter yet greater than the outer diameter of the sidewall annular recess to permit reception of the flanges in the recess to lock the closure on the container.

17 Claims, 3 Drawing Sheets

LOCKING COVER WITH FLANGED BELT

CROSS REFERENCE TO RELATED APPLICATION

This is a continuation-in-part application of application Ser. No. 696,362, filed May 6, 1991.

FIELD OF THE INVENTION

This invention relates to containers and, more particularly, to a self-locking closure or lid for use with a container and, even more particularly, to a cleated belt for use with the self-locking closure or lid and the container.

BACKGROUND OF THE INVENTION

In one form of conventional shipping and storage container, a tubular side wall is formed of fibrous material or other material. It is conventional to provide metal securing rings at opposite ends of the side wall for securing closure walls thereacross. Such metal securing rings are relatively costly and heavy and are not fully satisfactory in the formation of a low cost shipping and storage container.

An alternative to such prior closures is described in my U.S. Pat. No. 4,805,798 which discloses a container and closure having fastening means in the form of a threaded connector or a lockable drawer.

In certain applications, such as disposal of hazardous waste, it is desirable that a closure not be removable. Particularly, with hazardous waste a drum with a closure is sent into an incinerator for destruction. The use of any of the above-described securing apparatus is unnecessary in such situations. Further, if a metal cover or retaining ring is used, then it is necessary to ultimately remove the metal from the incinerator.

On the other hand, after initially choosing to permanently seal a container, one may subsequently decide that they need to use either the container or it's contents, or both. Hence, it is desirable to be able to remove the closure and subsequently securely reinstall it to the container.

The present invention is directed to solving one or more of the problems discussed above in a novel and simple manner.

SUMMARY OF THE INVENTION

In accordance with the invention there is disclosed a flanged belt for use with a self-locking closure and a container.

Broadly, the belt is used with a closure and a container, the container having an annular end portion defining a radially outwardly opening annular recess. The closure comprises a generally circular closure wall, a generally cylindrical sidewall having an upper edge connected to the closure wall and an annular lower edge that can have generally circumferentially spaced slits where the sidewall can be cut to allow for access to the container's internal storage space. The sidewall has an inner diameter slightly greater than the outer diameter of the container annular end portion, and a radially inwardly extending ridge on an inside of the sidewall between the upper and lower ridges. The ridge has an inner diameter less than the container annular end portion outer diameter yet greater than an outer diameter of the annular recess so that when the closure is installed on the container at least one of the container end portion and the sidewall is temporarily deformed to permit reception of the ridge in the recess to lock the closure on the container.

The sidewall has a radially outwardly opening annular recess coaxial with the ridge. The flanged belt comprises a long, thin, flexible strap having an outer side and an inner side. The flanges are circumferentially spaced and longitudinally extend along the inner side of the belt. Each flange defines a parallelepiped. The flanges are spaced apart at a distance slightly greater than the distance between reinforcement ribs contained in the sidewall radially outwardly opening annular recess. The flanges taken together have an inner diameter less than the closure cylindrical sidewall outer diameter yet greater than the outer diameter of the sidewalls annular recess to permit reception of the flanges in the recess to lock the closure on the container. The belt length is defined by the length of the sides and is slightly greater than the length around the cylindrical sidewall of the closure enabling the belt to be wrapped around the outside of the cylindrical sidewall, generally coaxial with the sidewall annular recess to lock the closure on the container.

It is a feature of the invention that the cleated belt is formed of a flexible material.

It is a further feature of the invention to provide a plurality of circumferentially spaced, inwardly directed flanges positioned on the inner side of the belt.

It is a further feature of the invention to include a pair of radially outturned tabs at the opposite ends of the outer side of the belt.

In accordance with another aspect of the invention there is disclosed a mean for adjustably drawing the tabs toward each other comprising a lever and connecting link means. The tabs are provided with oppositely outwardly opening recesses adapted to cooperate with a portion of the lever and a portion of the connecting link, respectively, so as to retain the closure on the container by an overcenter disposition of the lever and link means.

It is a feature of the invention that the closure is formed of molded synthetic resin.

It is a further feature of the invention to provide a plurality of circumferentially spaced openings through the sidewall disposed between the ridge and the upper edge.

It is a further feature of the invention that the sidewall includes a plurality of circumferentially spaced trim portions of a first select wall thickness and a remainder of the sidewall is of a second select wall thickness greater than the first select wall thickness.

It is yet another feature of the invention that the sidewall includes a radially outwardly opening annular recess coaxial with the ridge.

It is still a further feature of the invention that the sidewall radially outwardly opening annular recess includes a plurality of circumferentially spaced, longitudinally extending reinforcement ribs therein.

Further features and advantages of the invention will readily be apparent from the specification and from the drawings.

DETAILED DESCRIPTION OF THE INVENTION

Figure 1:
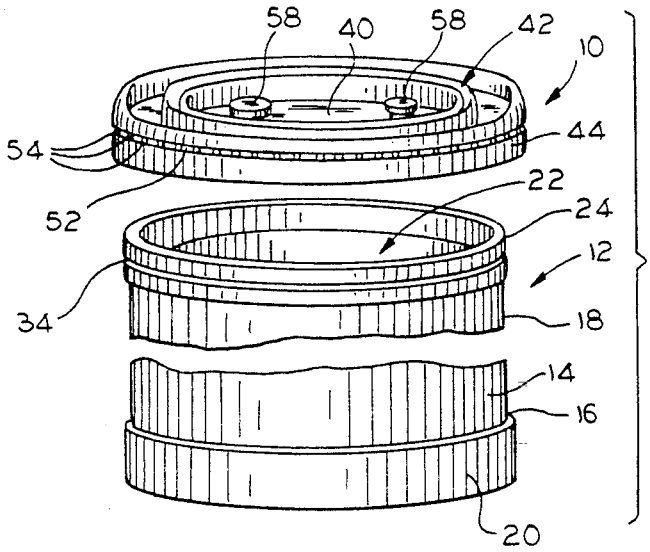
FIG. 1 is a fragmentary exploded view of a container and self-locking closure according to the invention.
Figure 2:
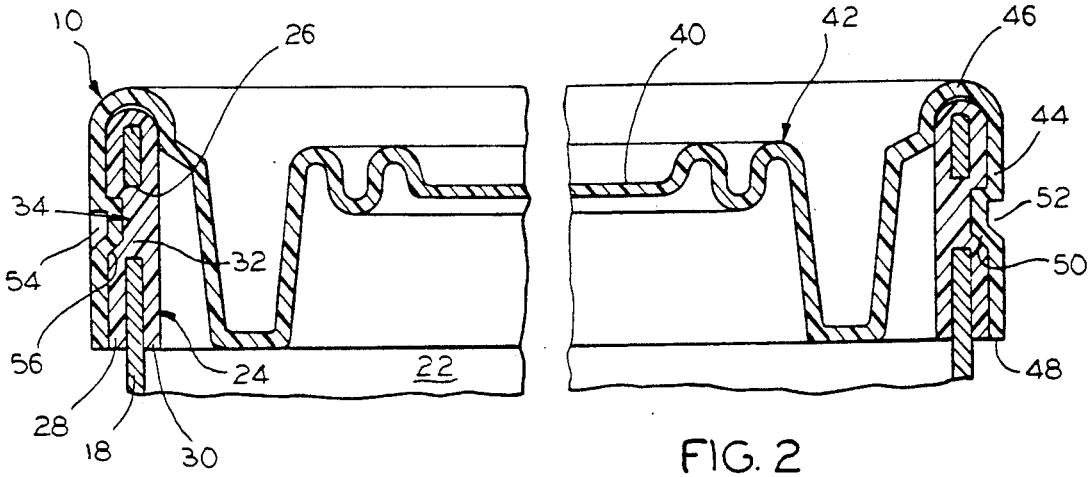
FIG. 2 is a fragmentary sectional view of the closure of FIG. 1 mounted on the container.
Figure 3:
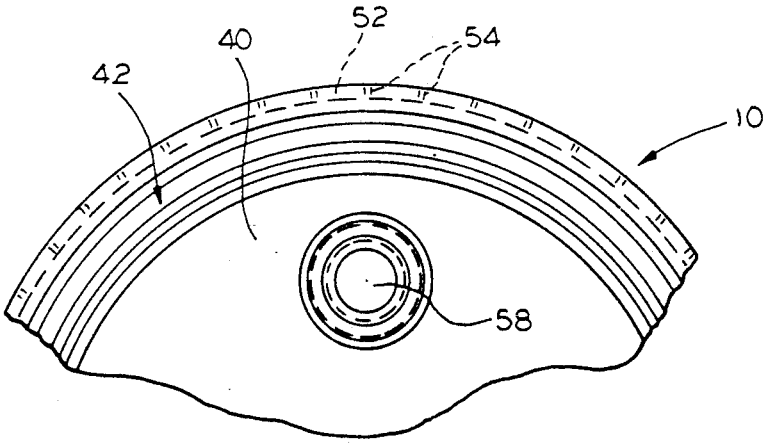
FIG. 3 is a partial plan view of the closure of FIG. 1.
Figure 4:
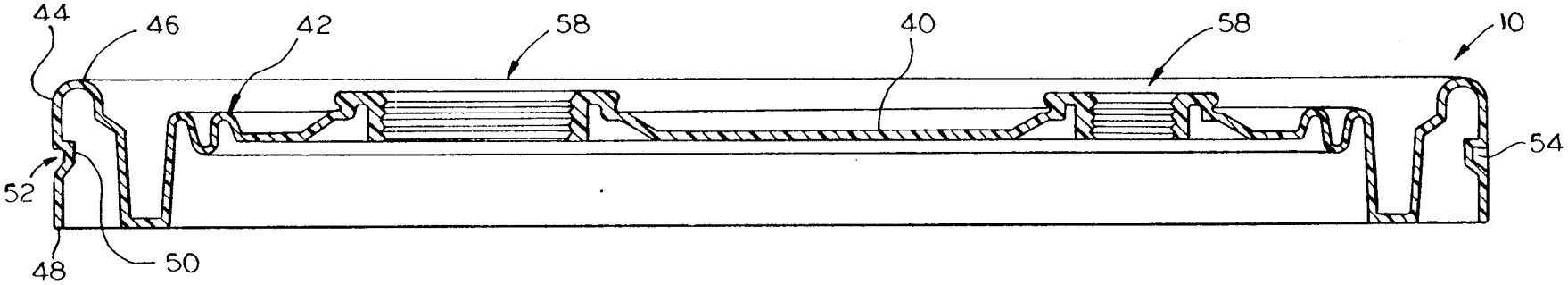
FIG. 4 is a sectional view of the closure of FIG. 1.

In a first embodiment of the invention, as illustrated in FIGS. 1–5 of the drawing, a self-locking closure 10 is shown for use with a container 12. The container 12 includes a fibrous, tubular sidewall 14. In the illustrated embodiment, the sidewall 14 defines a right cylinder, it being understood that the sidewall may define other configurations, such as square, oval, etc.

The sidewall 14 has a lower end portion 16 and an upper end portion 18. The lower end portion 16 is closed by a closure generally designated 20 fixedly secured to the sidewall lower end portion 16, as seen in FIG. 1. The tubular sidewall 14 and closure 20 define an internal storage space 22. The open upper end of the space 22 is selectively closed by the closure 10 securable to a connecting ring 24 fixedly secured to the sidewall upper end portion 18.

The bottom closure 20 comprises a unitary element molded of a suitable synthetic resin, such as high density polyethylene. The closure 20 is molded in situ in association with the sidewall lower end portion 18.

The connecting ring 24 is molded of synthetic resin in situ in association with the sidewall upper end portion 18. More specifically, the sidewall upper end portion 18 is provided with an array of through openings 26, see FIG. 2. The connecting ring 24 defines a pair of legs 28 and 30 joined by a connecting portion 32 extending through the openings 26. The connecting ring 24 is preferably molded in situ to the tubular side wall upper end portion 18 as by injection molding so as to secure the connecting ring 24 is sealed, clamped association.

The connecting ring 24 further includes a peripheral, radially outwardly opening annular recess 34 having an outwardly widening trapezoidal cross-section.

Although in the illustrated embodiment, the container 23 includes a fibrous sidewall 14 and molded closure 20 and retaining ring 24, alternative constructions could be utilized in connection with the closure 20 of the invention. Indeed, the particular form of the container 12 may be chosen by necessity except for the requirement that the container 12 include a radially outwardly opening annular recess such as the recess 34 shown in FIGS. 1 and 2.

The top closure 10 is of unitary construction and in the illustrated embodiment is injection molded of a suitable synthetic resin. The closure 10 includes a generally circular closure wall 40. The closure wall 40 includes indentations defining circular rings 42 to maintain the flatness of the closure wall 42 when it is molded and to act as an accordion pressure release if the container 14 tips over.

A generally cylindrical, continuous sidewall 44 has an upper edge 46 connected to the closure wall 40 and a continuous annular lower edge 48 positioned downwardly from the retaining ring annular recess 34, in use. The closure sidewall 48 has an inner diameter slightly greater than an outer diameter of the container retaining ring 24. The side wall 44 also includes a radially inwardly extending continuous ridge 50 on an inside of the sidewall 44 between the upper edge 46 and lower edge 48. The ridge 50 has an inner diameter less than the container retaining ring outer diameter yet greater than an outer diameter of the retaining ring annular recess 34. To facilitate molding, and provide uniform closure wall thickness, the sidewall 44 includes a radially outwardly opening annular recess 52 coaxial with and corresponding to the position of the ridge 50. A plurality of circumferentially spaced, longitudinally extending reinforcement ribs 54 are contained in the recess.

The sidewall inner ridge 50 is of inwardly narrowing trapezoidal cross-section corresponding to that of the retaining ring annular recess 34 and includes a diagonal lower wall portion 56. To cover the container 12, the closure 10 is positioned above the container 12 as illustrated in FIG. 1. The closure 10 is then lowered so that the sidewall 44 below the ridge 50 rests atop the container retaining ring 24. When a downward pressure is applied at the sidewall upper edge 46 the diagonal lower wall portion 56 acting on the retaining ring upper edge facilitates downward movement and, specifically, either the container upper end portion 18 or the sidewall 44 is temporarily deformed to permit reception of the ridge 50 in the retaining ring annular recess 34 to lock the closure 10 on the container 12. Once installed, an upper edge of the ridge 50 is effectively locked against an upper edge of the recess 34 to prevent removal. Since the sidewall lower edge 48 is continuous the closure 10 is virtually impossible to remove without destroying the same.

In order to facilitate providing access to the space 22, if necessary, the closure may include one or more spout openings 58 selectively closed by suitable caps (not shown).

Figure 6:
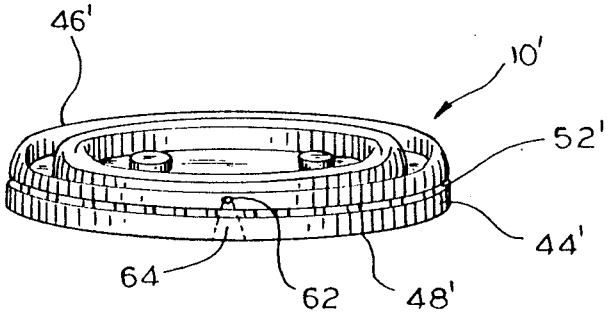
FIG. 6 is a perspective view of a closure according to an alternative embodiment of the invention.
Figure 5:
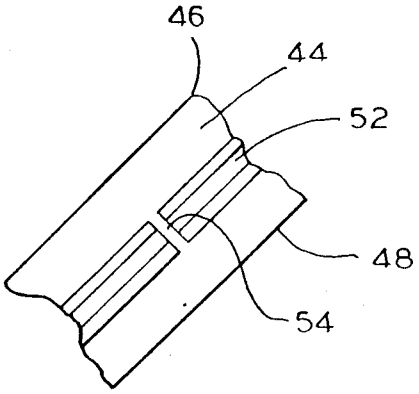
FIG. 5 is a fragmentary enlarged view illustrating an outer annular recess of the closure of FIG. 1.

The closure 10, discussed above, is suitable for applications where it is intended to be used one time only. It is also desirable to have a closure of a self-locking nature as described that can be reusable. With reference to FIG. 6, a closure 10' according to an alternative embodiment of the invention is illustrated. The closure 10' is virtually identical to the closure 10 discussed above. For simplicity like elements are referenced with like, primed reference numerals. The principal difference between the closure 10 and the closure 10' lies in the addition of a plurality of circumferentially spaced openings 62 through the sidewall upper edge 46'. These openings 62 provide a position where the sidewall 44' can be slit by inserting a knife or other implement in the openings 62 and slitting downwardly to the lower edge 48'.

To further facilitate removal, the sidewall 44' includes a plurality of circumferentially spaced trim portions 64 which are of triangular configuration having an apex at the openings 62. The trim portions 64 are of a first select wall thickness. The remainder of the sidewall 44' is of a second select wall thickness, greater than the first select wall thickness. The lesser wall thickness provides a wall that can be more easily cut by a knife or other instrument.

Figure 7:
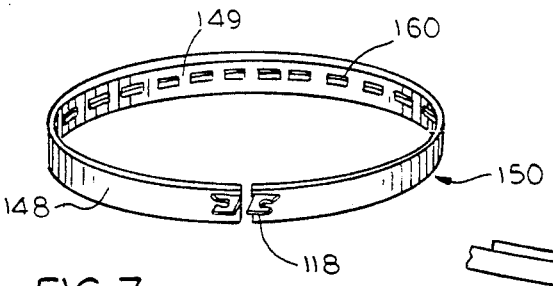
FIG. 7 is a perspective view of the cleated belt with tabs according to the invention.
Figure 13:
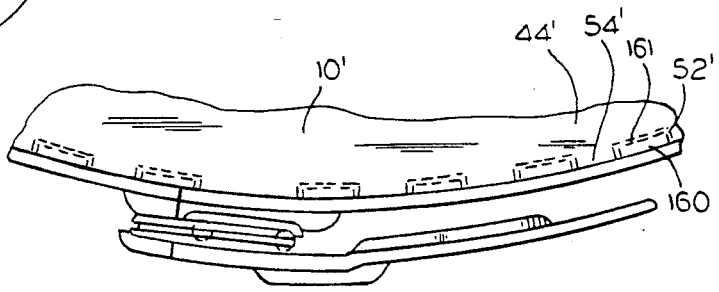
FIG. 13 is a fragmentary top plan view illustrating the arrangement of the lever and link means on the tabs and the arrangement of the cleats on the reinforcement ribs in the annular recess of the sidewall when in the locked disposition.

Once the closure 10' has been cut for removal, it can easily be reinstalled, although the self-locking effect is not as secure as the closure 10' no longer has a continuous lower edge 48'. To reseal the closure to the container, a flexible belt 150 as shown in FIG. 7 is placed around the sidewall 44'. The belt includes inwardly directed flanges 160 which are received in the annular recess 52' and engage the ridges 54' to maintain the belt in proper orientation with respect to the closure 10', and more particularly with respect to the annular recess 52' and the ridges 54' as illustrated in FIG. 13.

Figure 8:
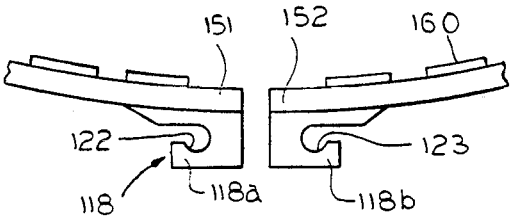
FIG. 8 is a fragmentary enlarged plan view of FIG. 7.
Figure 9:
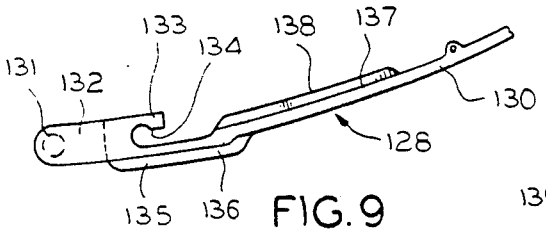
FIG. 9 is a side elevation of the lever according to the invention.

The belt includes an outer side 148 and an inner side 149. A pair of radially outturned tabs **118*a* and 118*b* as shown in FIGS. 7 and 8 are mounted on opposite ends 151 and 152 of the outer side 148 of the belt 150. A plurality of circumferentially spaced, longitudinally extending flanges 160 are positioned on the inner side of the belt 150. Each flange 160 defines a parallelepiped. The flanges 160 extend radially inwardly from the inner side 149 of the belt 150 forming a T-shaped cross section with the belt 150. Distal ends 161 of the flanges 160 are received in the annular recess 52' of the sidewall 44' when the belt 150 is fastened to the closure 10'. The flanges 160 are spaced apart from each other on the inner side 149 of the belt 150 at a distance slightly greater than the distance between the reinforcement ribs 54' contained in the sidewall recess 52'. The distal ends 161 of the flanges 160 taken together have an inner diameter less than the sidewall 44' yet greater than the outer diameter of the sidewall recess 52' to permit reception of the flanges 160 in the sidewall recess 52' to lock the closure 10' on the container 12**.

Tabs **118*a* and 118*b* are mounted on each end 151 and 152 of the outer side 148 of the belt 150 shown in FIG. 8. The tabs 118*a* and 118*b* are provided with oppositely opening circumferential recesses 122 and 123**, respectively. As shown, the wall of the respective tabs extends more than 180° about the recesses so as to define an undercut configuration.

Resealing the closure 10' after it has been cut for removal is accomplished by placing the flexible belt around the sidewall 44' so that it's flanges 160 are generally coaxial with both the closure's annular recess 52' and the container's annular recess 34. Fastening the belt results in the flanges 160 acting upon the annular recess 52' and the ridges 54' therein to constrict the closure sidewall portion 44' so as to close the generally circumferentially spaced slits in the closure's trim portions 64 that are located between the openings 62 and the lower edge 48' of sidewall 44' to produce a sealed effect as secure as if the closure 10' had not been cut open.

Figure 11:
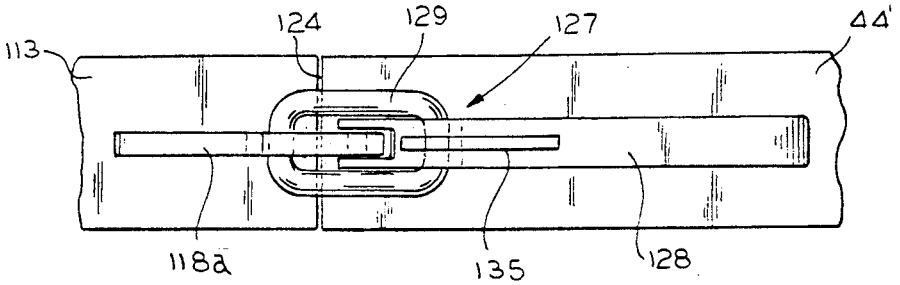
FIG. 11 is a fragmentary side elevation illustrating the arrangement of the lever and link means of FIGS. 9 and 10, respectively, on the tabs of the belt in the locked disposition.

Constriction of the sidewall portion 44' is effected by drawing together the spaced tabs **118*a* and 118*b* on the flanged belt 150 to a juxtaposed position shown in FIGS. 11 and 13**.

The means for fastening the belt to the closure and thereby constricting the wall portion 113 comprises a retaining means generally designated 127. The retaining means includes a lever 128 and a loop element 129.

Lever 128 includes a handle portion 130 at one end, a cylindrical pivot 131 mounted to a bifurcated opposite end 132 of the lever 128.

A hook portion 133 is provided at the end 132 and defines an outwardly opening recess 134, which is similar to the recesses 122 in having a circular cross section extending slightly more than 180°.

The lever 128 defines an outer surface 135 provided with an outwardly projecting longitudinally extending rib 136, an inner surface 137 provided with an inwardly projecting longitudinally extending rib 138.

Figure 10:
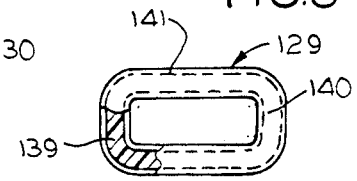
FIG. 10 is a fragmentary elevation of the connecting link means according to the invention.

Referring to FIG. 10, the loop element 129 defines opposite rectilinearly extending ends 139 and 140. The loop element 129 may be provided with a peripheral outwardly opening recess 141.

Figure 12:
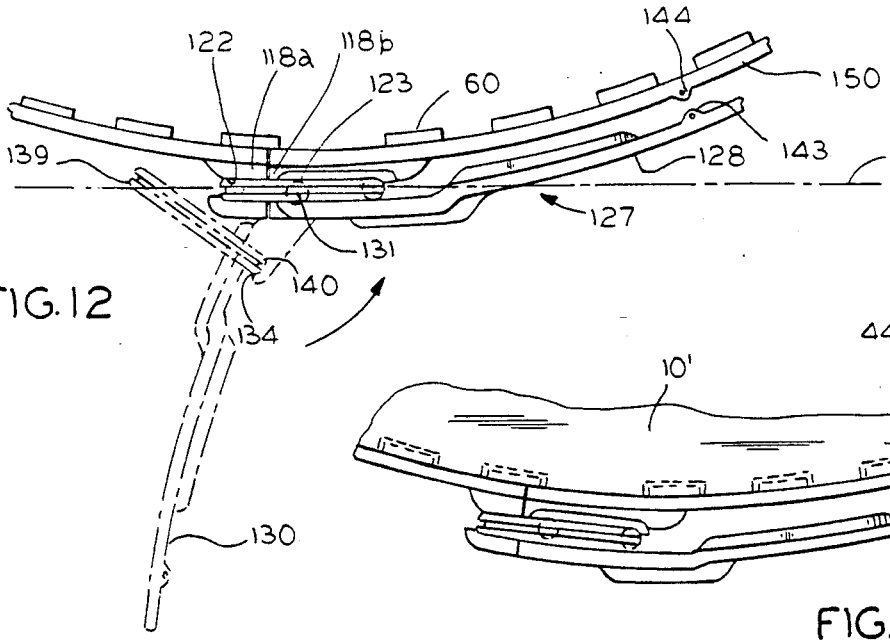
FIG. 12 is a fragmentary top plan view illustrating the movement of the lever and link from an initial position in dotted lines to the locking position in full lines.

Retaining means 127 is mounted to the tabs 118 by firstly positioning the loop element end 139 in the recess 122 of the tab **118*a* with the pivot 131 of the lever received in the recess 123 of the opposite tab 118*b*, and the opposite end 140 of the loop element received in the recess 134 of the lever hook portion 133, as illustrated in broken lines in FIG. 12**.

Handle portion 130 of the lever is then pivoted in a counterclockwise direction, as seen in FIG. 12, with the pivot rotating in the recess 123 of the tab **118*b*, to an overcenter position wherein a line 142 drawn through the center of the loop element ends 139 and 140 lies inwardly of the axis of the pivot 131, as seen in full lines in FIG. 12. The spacing of the recess 134 from the axis of the pivot 131 of lever 128 is correlated with the length of the loop element between ends 139 and 140 so that the notch 124 is constricted to a substantially closed disposition, as seen in FIG. 11, with the handle in the overcenter locking disposition of FIGS. 11 and 13, and the full line disposition in FIG. 12**.

As further shown in FIGS. 12 and 13, the lever handle portion 128 is spaced outwardly of the belt 150 in the locking disposition so as to facilitate release of the locking means, when desired, by insertion of the user's fingers between the handle portion 128 and the belt 150. However, as a result of the overcenter locking arrangement, the closure is positively retained in association with the drum end under a substantial locking force acting between the loop element end 139 and pivot 131 received in the tab recesses 122 and 123, respectively.

The form of constricting and locking means of the embodiment of FIGS. 6–13 provides the advantage of permitting the locking of the closure to the container end without the need for tools.

Lever handle portion 128 may be provided with an inwardly extending projecting 143 adjacent the distal end thereof for limiting the inward movement of the handle portion and thereby avoiding pinching of the user's fingers in swinging the lever to the overcenter locking position. As further shown in FIG. 12, if desired, the belt 150 may be provided with an outwardly projecting similar projection 144.

The foregoing disclosure of specific embodiments is illustrative of the broad inventive concepts comprehended by the invention.

I claim:

1. In a container having an annular end portion defining a radially outwardly opening annular recess and a closure having a radially inwardly extending ridge receivable in said recess to maintain said closure on said container, a belt for securing a closure to a container comprising:

a generally long, flexible strap having an outer side and an inner side with longitudinally extending, radially inwardly projecting flanges mounted on the inner side received in a radially outwardly opening annular recess on the closure; and means for fastening the strap so that said closure ridge is maintained in said container recess to secure the closure to the container.

2. The belt of claim 1 wherein the strap is formed of molded synthetic resin.

3. A flanged belt for used with a container having an annular end portion defining a radially outwardly opening annular recess and a closure having a center wall transversely connected to a cylindrical sidewall having a radially inwardly extending ridge receivable in said container recess to maintain said closure on said container said side wall further having, trim portions that have been slit to provide easy removal of the closure for access to the container's storage space and a radially outwardly opening annular recess, said belt comprising:

a generally long, flexible strap having an outer side and an inner side with longitudinally extending, radially inwardly projecting flanges mounted on the inner side received in a radially outwardly opening annular recess on the closure; and means for fastening the strap to urge the flanges radially inwardly, the flanges being adapted to be fitted into an annular recess of the closure sidewall as a result of such fastening of the strap.

4. The belt of claim 3 wherein the strap is formed of molded synthetic resin.

5. The belt of claim 3 wherein said closure annular recess includes a plurality of circumferentially spaced, longitudinally extending reinforcement ribs therein and wherein said flanges comprise a plurality of circumferentially spaced flanges each adapted to be fitted into the annular recess of the closure sidewall in between adjacent reinforcement ribs.

6. The belt of claim 3 wherein the means for fastening the strap comprises a pair of radially outturned tabs mounted on opposite ends of the outer side of the strap, and retaining means movable to an overcenter position for adjustably drawing the tabs toward each other and releasably locking the securing structure in the annular recess when the retaining means is in the overcenter position.

7. A flanged belt for use with a container sealed by a closure, the container having an annular end portion defining a radially outwardly opening annular recess, and the closure having a transverse center wall connected to a cylindrical sidewall having trim portions that have been slit to provide access to the container's storage space and a radially outwardly opening annular recess, said belt comprising:

a generally long, flexible strap having an outer side and an inner side with longitudinally extending, radially inwardly projecting flanges mounted on the inner side received in a radially outwardly opening annular recess on the closure; and means for fastening the strap to urge the flanges radially inwardly, the flanges being adapted to be fitted into an annular recess of the closure sidewall as a result of such fastening of the strap, the means for fastening the strap comprises a pair of radially outturned tabs mounted on opposite ends of the outer side of the strap, and retaining means movable to an overcenter position for adjustably drawing the tabs toward each other and releasably locking the securing structure in the annular recess when the retaining means is in the overcenter position, said retaining means comprising a loop element having a first portion embracing one of said tabs, and an opposite second portion, and a lever having a first portion partially engaging the other of said tabs, and a second portion embracing said second portion of the loop element being disposed in an overcenter disposition relative to a line through said first portion of the lever in said overcenter position of said retaining means.

8. The belt of claim 7 wherein said first an second portions of the loop element comprise parallel rectilinear portions.

9. The belt of claim 7 wherein said tabs define circular openings facing outwardly away from each other, said tabs extending about said openings greater than 180°.

10. The belt of claim 7 wherein said tabs define circular openings facing outwardly away from each other, said tabs extending about said openings greater than 180°, said first portion of the loop element having a circular cross section and being received in the opening of one of said tabs, said first portion of the loop element having a diameter substantially equal to the diameter of the circular opening in which it is received.

11. The belt of claim 7 wherein said tabs define circular openings facing outwardly away from each other, said tabs extending about said openings greater than 180°, said first portion of the lever having a circular cross section and being received in the opening of one of said tabs, said first portion of the lever having a diameter substantially equal to the diameter of the circular opening in which it is received.

12. The belt of claim 7 wherein said tabs define circular openings facing outwardly away from each other, said tabs extending about said openings greater than 180°, said first portion of the loop element having a circular cross section and being received in the opening of one of said tabs, said first portion of the loop element having a diameter substantially equal to the diameter of the circular opening in which it is received, said first portion of the lever having a circular cross section and being received in the opening of the other of said tabs, said first portion of the lever having a diameter substantially equal to the diameter of the circular opening in which it is received.

13. The belt of claim 7 wherein said lever comprises an elongated member defining an outer surface, an inner surface, and opposite ends, said second portion of the lever extending inwardly from said inner surface at one of said ends.

14. The belt of claim 7 wherein said lever comprises an elongated member defining an outer surface, an inner surface, and opposite ends, said second portion of the lever extending inwardly from said inner surface at one of said ends, said lever having a longitudinally extending rib on said outer surface outwardly of said second portion thereof.

15. The belt of claim 7 wherein said lever comprises an elongated member defining an outer surface, an inner surface, and opposite ends, said second portion of the lever extending inwardly from said inner surface at one of said ends, said first portion of the lever being disposed at a distal portion of said one of said ends.

16. The belt of claim 7 wherein said lever comprises an elongated member defining an outer surface, an inner surface, and opposite ends, said second portion of the lever extending inwardly from said inner surface at one of said ends, said lever having a first, longitudinally extending rib on said outer surface outwardly of said second portion thereof, and a second, longitudinally extending rib on said inner surface adjacent the other of said opposite ends.

17. A flanged belt and a closure assembly for use with a container having an annular end portion defining a radially outwardly opening annular recess, the assembly comprising:

a generally circular closure wall;

a generally cylindrical, sidewall having an upper edge connected to said closure wall and a annular a lower edge, said sidewall having an inner diameter slightly greater than an outer diameter of said container annular end portion;

a radially inwardly extending ridge on an inside of said sidewall between said upper and lower edges, said ridge having an inner diameter less than said container annular end portion outer diameter yet greater than an outer diameter of said annular recess, so that when said closure is installed on said container at least one of said container end portion and said sidewall is temporarily deformed to permit reception of said ridge in said recess to lock said closure on said container;

a radially outwardly opening annular recess on an outside of said sidewall coaxial with the radially inwardly extending ridge;

a generally long, flexible strap having an outer side and an inner side with longitudinally extending and radially inwardly projecting flanges mounted on the inner side received in the radially outwardly opening annular recess on the closure; and means for fastening the strap to urge the flanges radially inwardly, the flanges being adapted to be fitted into an annular recess of the closure sidewall as a result of such fastening of the strap.

* * * * *